US009086010B2

(12) United States Patent
Oda

(10) Patent No.: US 9,086,010 B2
(45) Date of Patent: Jul. 21, 2015

(54) RICH-LEAN BURNER

(71) Applicant: PALOMA CO., LTD., Nagoya-Shi (JP)

(72) Inventor: Hiroshi Oda, Nagoya (JP)

(73) Assignee: Paloma Co., Ltd., Nagoya-Shi (JP)

( * ) Notice: Subject to any disclaimer, the term of this patent is extended or adjusted under 35 U.S.C. 154(b) by 268 days.

(21) Appl. No.: 13/855,984

(22) Filed: Apr. 3, 2013

(65) Prior Publication Data

US 2013/0312700 A1 Nov. 28, 2013

(30) Foreign Application Priority Data

May 23, 2012 (JP) ..... 2012-117824

(51) Int. Cl.

| | |
|---|---|
| ***F23D 14/02*** | (2006.01) |
| ***F02B 17/00*** | (2006.01) |
| ***F23D 14/70*** | (2006.01) |
| ***F23D 23/00*** | (2006.01) |

(52) U.S. Cl.

CPC ..... *F02B 17/00* (2013.01); *F23D 14/02* (2013.01); *F23D 14/70* (2013.01); *F23D 23/00* (2013.01); *F23C 2201/20* (2013.01); *F23C 2900/06043* (2013.01); *F23D 2203/101* (2013.01); *F23D 2203/102* (2013.01); *F23D 2900/11401* (2013.01); *F23D 2900/21003* (2013.01)

(58) Field of Classification Search

CPC ..... F23C 3/002; F23D 14/02; F23D 14/14; F23D 14/145; F23D 14/74; F23D 14/82

USPC ..... 431/187, 284

See application file for complete search history.

(56) References Cited

U.S. PATENT DOCUMENTS

| | | | | | |
|---|---|---|---|---|---|
| 3,233,653 | A | * | 2/1966 | Nakamura et al. | 431/329 |
| 3,737,281 | A | * | 6/1973 | Guth | 431/352 |
| 4,453,913 | A | * | 6/1984 | Gitman | 431/8 |
| 4,654,001 | A | * | 3/1987 | LaRue | 431/354 |
| 4,723,513 | A | * | 2/1988 | Vallett et al. | 122/18.4 |
| 4,793,800 | A | * | 12/1988 | Vallett et al. | 431/328 |
| 4,904,179 | A | * | 2/1990 | Drago et al. | 431/2 |
| 5,090,339 | A | * | 2/1992 | Okiura et al. | 110/263 |
| 5,109,806 | A | * | 5/1992 | Duggan et al. | 122/18.1 |
| 5,197,415 | A | * | 3/1993 | Stretch et al. | 122/14.22 |
| 5,199,866 | A | * | 4/1993 | Joshi et al. | 431/353 |
| 5,203,689 | A | * | 4/1993 | Duggan et al. | 431/114 |
| 5,271,729 | A | * | 12/1993 | Gensler et al. | 431/175 |
| 5,370,529 | A | * | 12/1994 | Lu et al. | 431/353 |

(Continued)

FOREIGN PATENT DOCUMENTS

| | | | | |
|---|---|---|---|---|
| GB | 191510294 | A | * | 4/1916 |
| JP | 06-147426 | A1 | | 5/1994 |

*Primary Examiner* — Jorge Pereiro

(74) *Attorney, Agent, or Firm* — Burr & Brown, PLLC

(57) ABSTRACT

A rich-lean burner includes an inner cylinder to which lean gas, which is a mixture of gas and combustion air, is supplied, and an outer cylinder that is coaxially disposed around the inner cylinder such that rich gas, which is a mixture of gas and combustion air, is supplied between the inner cylinder and the outer cylinder. A burner head, which has small holes and whose diameter decreases toward the leading end, is provided on an opening of the inner cylinder. The burner head is obtained by forming a perforated metal, in which the small holes are arranged in a zigzag manner, into a conical shape. An interval between each of the small holes is two to three times the diameter of the small holes. The total area of the small holes is larger than the area of an upper end opening of an upper inner cylinder.

2 Claims, 7 Drawing Sheets

(56) References Cited

U.S. PATENT DOCUMENTS

| | | | | |
|---|---|---|---|---|
| 5,546,925 | A * | 8/1996 | Knight et al. | 126/110 R |
| 5,649,529 | A * | 7/1997 | Lu et al. | 126/116 R |
| 5,655,899 | A * | 8/1997 | Hura et al. | 431/8 |
| 6,065,963 | A * | 5/2000 | Dewaegheneire et al. | 431/329 |
| 6,250,915 | B1 * | 6/2001 | Satchell et al. | 432/19 |
| 6,474,982 | B2 * | 11/2002 | Satchell et al. | 432/19 |
| 6,910,431 | B2 * | 6/2005 | Satchell, Jr. | 110/347 |
| 7,717,700 | B2 * | 5/2010 | Carroni et al. | 431/7 |
| 8,591,222 | B2 * | 11/2013 | Sherrow | 431/353 |
| 2001/0036611 | A1 * | 11/2001 | Satchell et al. | 432/19 |
| 2004/0123784 | A1 * | 7/2004 | Satchell, Jr. | 110/261 |
| 2005/0252430 | A1 * | 11/2005 | Satchell, Jr. | 110/347 |
| 2006/0035189 | A1 * | 2/2006 | Berstecher et al. | 431/329 |
| 2011/0081621 | A1 * | 4/2011 | Lamberts et al. | 431/350 |

* cited by examiner

RICH-LEAN BURNER

CROSS-REFERENCE TO RELATED APPLICATION

This application claims the benefit of Japanese Patent Application Number 2012-117824 filed on May 23, 2012, the entirety of which is incorporated by reference.

BACKGROUND OF THE INVENTION

1. Field of the Invention

The present invention relates to a rich-lean (off-stoichiometric) burner (a low NOx burner) that includes an inner tube to which lean gas is supplied, and an outer tube which is coaxially disposed around the inner tube and to which rich gas is supplied. The rich-lean burner is used in a gas combustion device, such as a warm air heater.

2. Description of Related Art

In a gas combustion device, such as a warm air heater, a rich-lean burner (a low NOx burner) is used in some cases in order to reduce a discharge amount of NOx (nitrogen oxides). The rich-lean burner forms a main flame by causing an air-fuel mixture (lean gas) in which the fuel is leaner than a stoichiometric air-fuel ratio to combust in a lean flame hole, and forms a pilot flame by causing an air-fuel mixture (rich gas) in which the fuel is richer than the stoichiometric air-fuel ratio to combust in a rich flame hole that is adjacent to the lean flame hole.

For example, Japanese Patent Application Publication No. JP 6-147426A discloses a rich-lean burner which includes a double tube having an inner tube and an outer tube, and in which an end portion of the inner tube is used as a lean flame hole and a space between the inner tube and the outer tube is used as a rich flame hole. In the rich-lean burner, an entire end face of the double tube is covered by wire netting in order to achieve stable ignition and improve mixture of lean gas.

SUMMARY OF THE INVENTION

However, in the rich-lean burner disclosed in Japanese Patent Application Publication No. JP 6-147426A, a total area of the lean flame hole is determined by a diameter of the inner tube. Therefore, a flame surface area cannot be increased by increasing the total area of the lean flame hole, and stable combustion is not achieved.

In light of the above, the present invention provides a rich-lean burner that can achieve stable combustion by increasing a flame surface area.

A first aspect of the invention provides a rich-lean burner including an inner cylinder to which lean gas is supplied, the lean gas being a mixture of gas and combustion air, and an outer cylinder that is coaxially disposed around the inner cylinder such that rich gas is supplied between the inner cylinder and the outer cylinder, the rich gas being a mixture of gas and combustion air. A protruding body, which has a plurality of small holes and whose diameter decreases toward a leading end of the protruding body, is provided on an opening of the inner cylinder.

A second aspect of the invention is structured such that, in the configuration of the first aspect, a total area of the small holes is equal to or more than an area of the opening of the inner cylinder.

A third aspect of the invention is structured such that, in the configuration of the first aspect or the second aspect, an intermediate cylinder, which is communicatively connected with the inside of the inner cylinder and to which the lean gas is supplied, is coaxially provided on an outer periphery of the inner cylinder, on an inner side of the outer cylinder.

According to the first aspect of the invention, it is possible to achieve stable combustion by increasing the surface area of lean gas flames formed on the surface of the protruding body.

According to the second aspect of the invention, in addition to the effects of the first aspect, the surface area of the lean gas flames is reliably increased, which is favorable for stable combustion.

According to the third aspect of the invention, in addition to the effects of the first and second aspects, a flame of the lean gas, whose flow rate is lower than that of the lean gas blown out from the small holes, is formed at the base of the protruding body. Therefore, stability of the lean gas flames is increased.

DETAILED DESCRIPTION OF THE INVENTION

Hereinafter, an embodiment of the present invention will be explained with reference to the drawings.

Figure 1A:
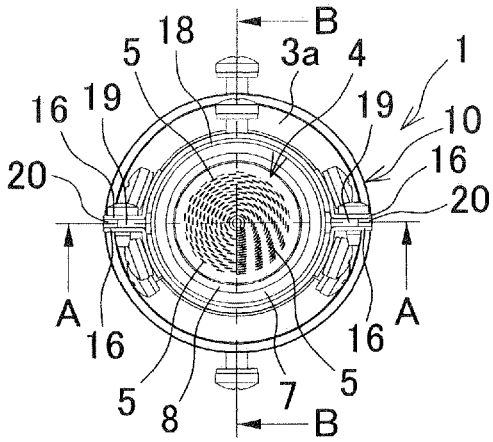
FIG. 1 is an explanatory diagram of a rich-lean burner, where (A) shows a plane surface and (B) shows a front surface.
Figure 1B:
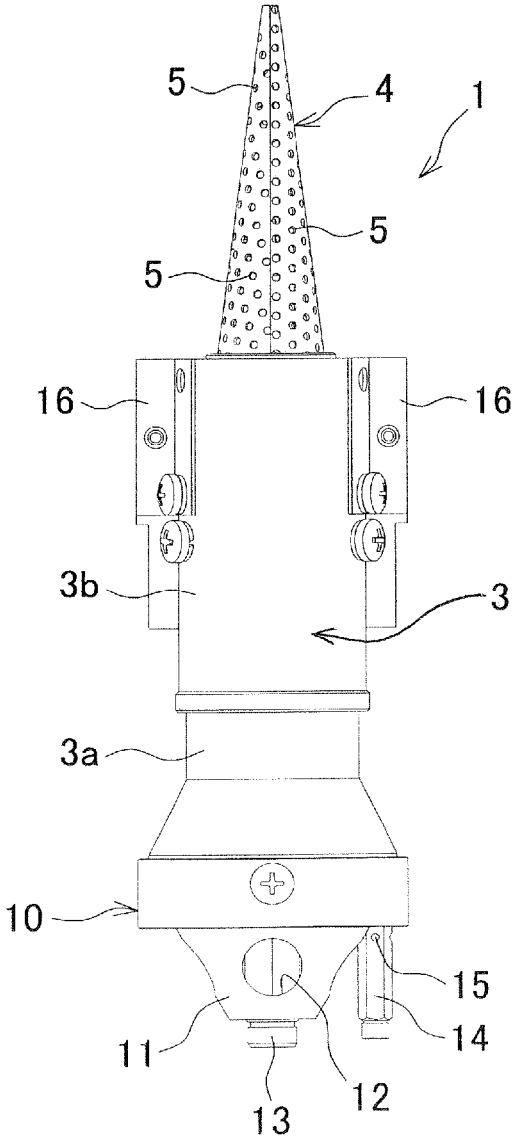
Figure 2:
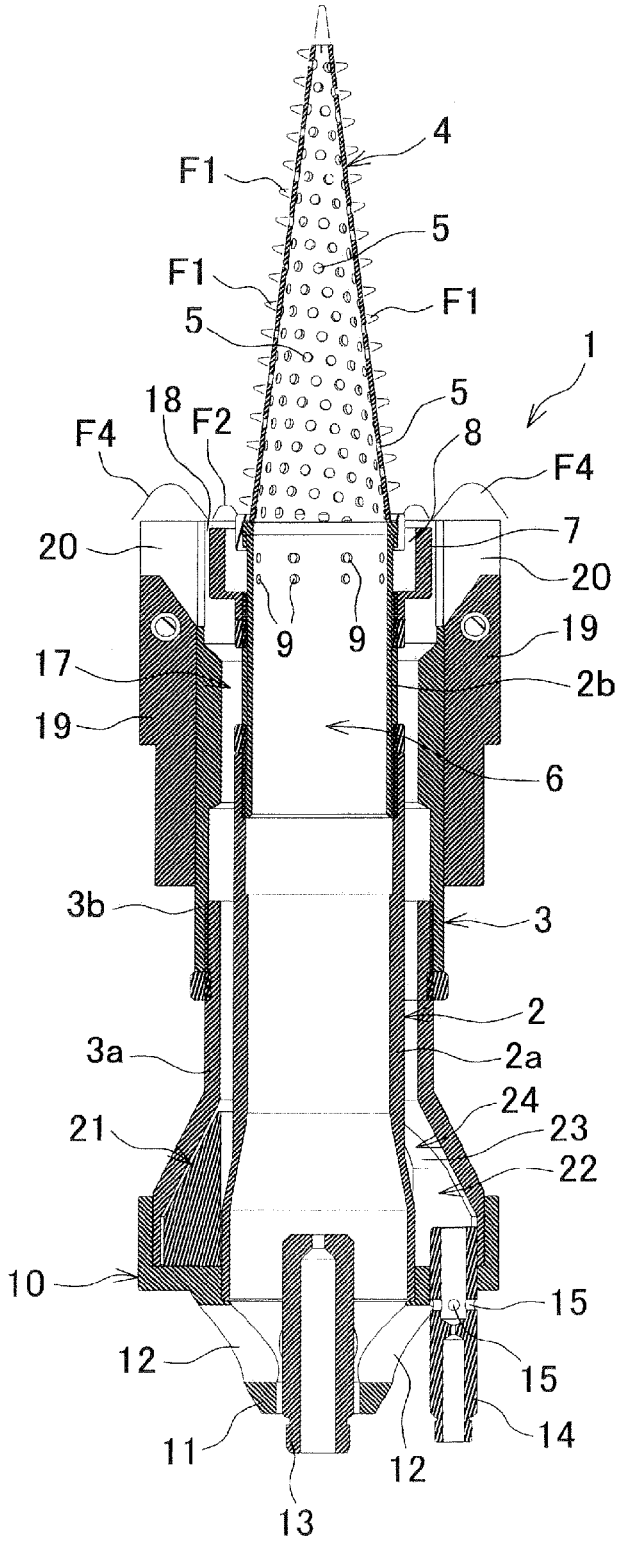
FIG. 2 is a cross sectional view taken along a line A-A shown in FIG. 1.
Figure 3:
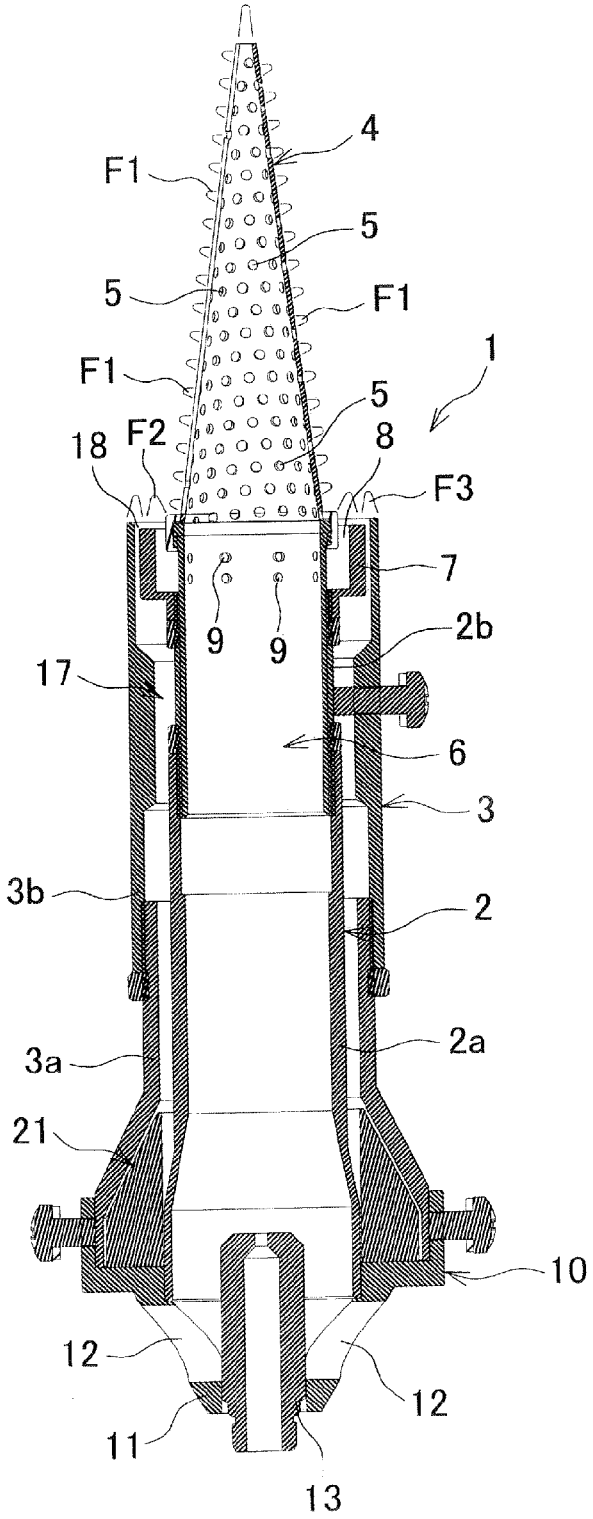
FIG. 3 is a cross sectional view taken along a line B-B shown in FIG. 1.

FIG. 1 is an explanatory diagram showing an example of a rich-lean burner 1, and (A) shows a plane surface and (B) shows a front surface. FIG. 2 shows a cross section taken along a line A-A in FIG. 1, and FIG. 3 shows a cross section taken along a line B-B in FIG. 1.

The rich-lean burner 1 has a double tube structure, and includes an inner cylinder 2 and an outer cylinder 3 that is coaxially disposed around the inner cylinder 2.

First, the inner cylinder 2 includes a lower inner cylinder 2*a* and an upper inner cylinder 2*b* that is coaxially inserted into the lower inner cylinder 2*a*. A conical burner head 4, which is a protruding body, is coaxially fitted into an upper end opening of the upper inner cylinder 2*b*. The burner head 4 is made of a perforated metal, in which a plurality of small holes (lean flame holes) 5 are arranged in a zigzag manner, into a conical shape. A spacing between each of the small holes 5 is two to three times the diameter of the small holes 5. Further, a total area of the small holes 5 is larger than the area of the upper end opening of the upper inner cylinder 2*b*.

Therefore, a lean gas flow path 6 is formed, through which lean gas flows upward inside the inner cylinder 2 and reaches each of the small holes 5.

Further, an intermediate cylinder 7 is fitted around the outer periphery of the upper end of the upper inner cylinder 2*b*, and a ring-shaped lean flame sub-hole 8 is formed between the intermediate cylinder 7 and the upper inner cylinder 2*b*. The lower end of the intermediate cylinder 7 is closed and the upper end of the intermediate cylinder 7 is open. In a section of the upper inner cylinder 2*b* around which the intermediate cylinder 7 is fitted, a plurality of through holes 9 are formed at a predetermined interval in a circumferential direction. Thus, the inside of the inner cylinder 2 is communicatively connected with the lean flame sub-hole 8.

A reference numeral 10 denotes a disc-shaped base, and the lower end of the lower inner cylinder 2*a* is coaxially inserted into the base 10. Primary air introduction holes 12 are formed in a protruding portion 11 that protrudes downward, and a lean gas nozzle 13 is held by the protruding portion 11 such that the lean gas nozzle 13 has an upward orientation. The primary air introduction holes 12 have a large diameter, and are communicatively connected with the inside of the lower inner cylinder 2*a*. The lean gas nozzle 13 is coaxially and loosely inserted into a lower end opening of the lower inner cylinder 2*a*.

The outer cylinder 3 is formed by a lower outer cylinder 3*a* and an upper outer cylinder 3*b*. The lower outer cylinder 3*a* is assembled to the base 10, and is coaxially disposed around the lower inner cylinder 2*a* such that the lower outer cylinder 3*a* is not in contact with the lower inner cylinder 2*a*. The upper outer cylinder 3*b* is coaxially connected to the lower outer cylinder 3*a*. A lower half of the lower outer cylinder 3*a* is formed in a tapered shape such that its diameter becomes larger toward the lower side. A rich gas nozzle 14 is attached to the base 10 between the lower inner cylinder 2*a* and the lower outer cylinder 3*a* such that the rich gas nozzle 14 has an upward orientation, and primary air introduction holes 15 having a small diameter are provided in a side surface of the rich gas nozzle 14.

The upper outer cylinder 3*b* is a housing in which slits are respectively formed in symmetric positions with respect to a point from the upper end of the upper outer cylinder 3*b*, and flanges 16 are respectively fastened by screws such that each of the slits is interposed between the flanges 16. A rich gas flow path 17, through which rich gas flows upward between the inner cylinder 2 and the outer cylinder 3 and reaches a rich flame hole 18 is formed between the inner cylinder 2 and the outer cylinder 3 in an assembled state. The rich flame hole 18 is provided between the intermediate cylinder 7 and the upper outer cylinder 3*b*.

Further, the mutually opposing flanges 16 are fastened to each other by screws, and a plate-shaped spacer 19 is interposed between the opposing flanges 16 apart from the upper ends of the flanges 16. A flattened lire spreading flow path 20, which communicatively connects with the rich gas flow path 17 via the slits, is formed between the facing flanges 16.

Figure 4:
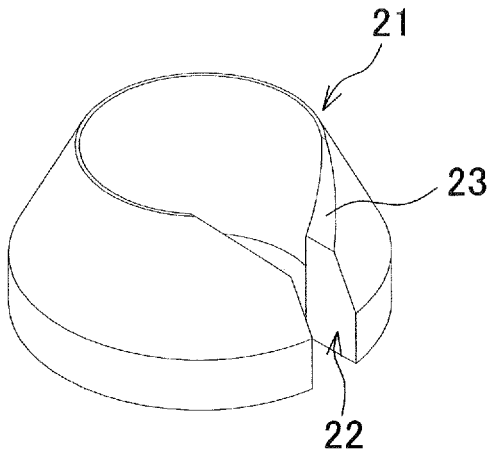
FIG. 4 is a perspective view of a core.
Figure 5A:
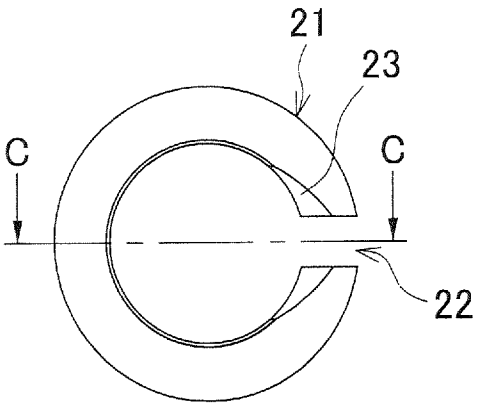
FIG. 5 is an explanatory diagram of the core, where (A) shows a plane surface, (B) shows a front surface and (C) shows a C-C cross section.
Figure 5B:
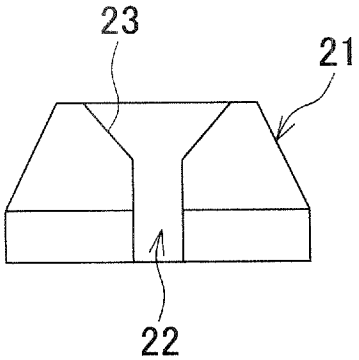
Figure 5C:
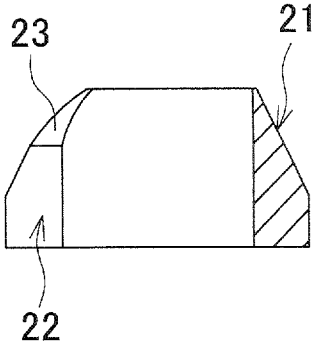

A core 21 is accommodated between the lower inner cylinder 2*a* and the lower outer cylinder 3*a*. As shown in FIG. 4 and FIG. 5, the core 21 is a ring body having a C shape in a plan view, and includes a slit 22 into which the rich gas nozzle 14 is inserted. Expanding portions 23 having a V shape are formed on the upper side of the slit 22 such that an interval between the expanding portions 23 gradually widens toward the upper side. Further, the core 21 has a tapered shape in which its thickness and diameter become larger toward the lower side, in accordance with the tapered shape of the lower outer cylinder 3*a*.

Therefore, a guide path 24 is formed by the core 21, between the lower inner cylinder 2*a* and the lower outer cylinder 3*a*. The guide path 24 is located on an extension of the rich gas nozzle 14, and expands toward the upper side and approaches an axis center of the lower inner cylinder 2*a*.

In the rich-lean burner 1 structured as described above, when fuel gas is supplied to the lean gas nozzle 13, the fuel gas is blown upward from the lean gas nozzle 13. Thus, primary air is sucked in from the primary air introduction holes 12 and the fuel gas and the primary air are mixed in the inner cylinder 2 to form lean gas (having an equivalence ratio of 1.0 or less). The lean gas flows upward through the lean gas flow path 6, and is blown from each of the small holes 5 of the burner head 4. Therefore, when the lean gas is ignited by an ignition electrode (not shown in the drawings), the lean gas burns and flames F1 are formed at each of the small holes 5.

Further, a part of the lean gas in the lean gas flow path 6 flows out from the through holes 9 of the upper inner cylinder 2*b* into the intermediate cylinder 7, and then is blown upward from the lean flame sub-hole 8 to burn. As a result, a lean gas flame F2 is formed in a ring shape at the base of the burner head 4. It should be noted that the velocity of the lean gas blown out from the lean flame sub-hole 8 is lower than the velocity of the lean gas blown out from each of the small holes 5 of the burner head 4.

On the other hand, when fuel gas is supplied to the rich gas nozzle 14, primary air is sucked in from the primary air introduction holes 15, and rich gas (having an equivalence ratio of 1.0 or more) that is a mixture of the fuel gas and the primary air is blown upward. The rich gas flows through the guide path 24 in a section of the core 21, and thus the rich gas flows around the inner cylinder 2 while expanding. Therefore, the rich gas flows upward in a state in which the rich gas is uniformly spread in the rich gas flow path 17. Then, the rich gas is blown from the rich flame hole 18 provided between the inner cylinder 2 and the outer cylinder 3, and a ring-shaped rich gas flame F3 is formed. Further, since the rich flame hole 18 is communicatively connected with the fire spreading flow path 20, the rich gas blown from the fire spreading flow path 20 also burns and a rich gas flame F4 is formed.

In this manner, since the rich gas flame F3 is formed in a ring shape around the burner head 4, the lean gas flame F2 is held and flame lifting phenomenon is inhibited. As a result, stable combustion becomes possible. In addition, NOx reduction can also be achieved.

Figure 6:
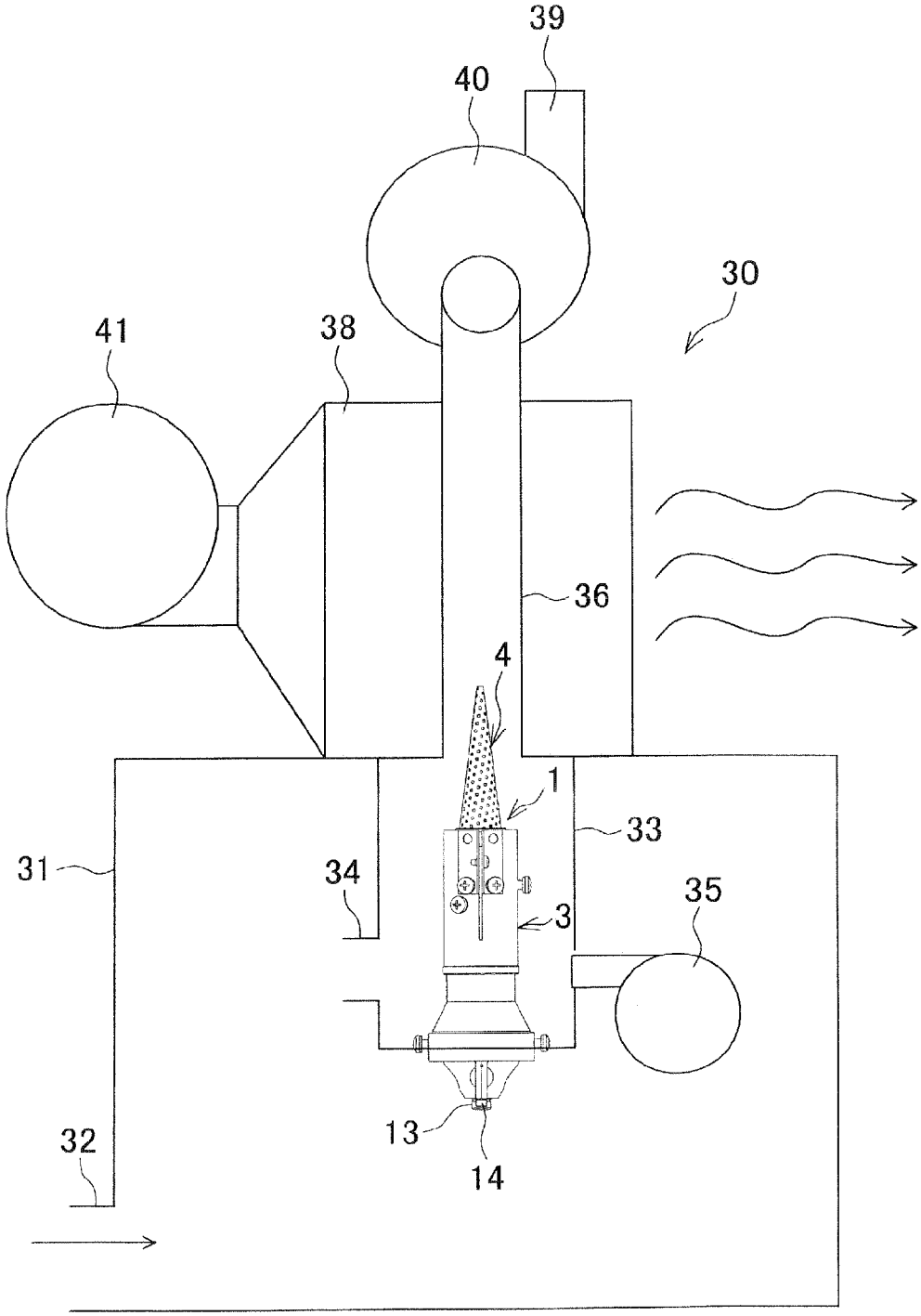
FIG. 6 is a schematic diagram of a warm air heater.
Figure 7:
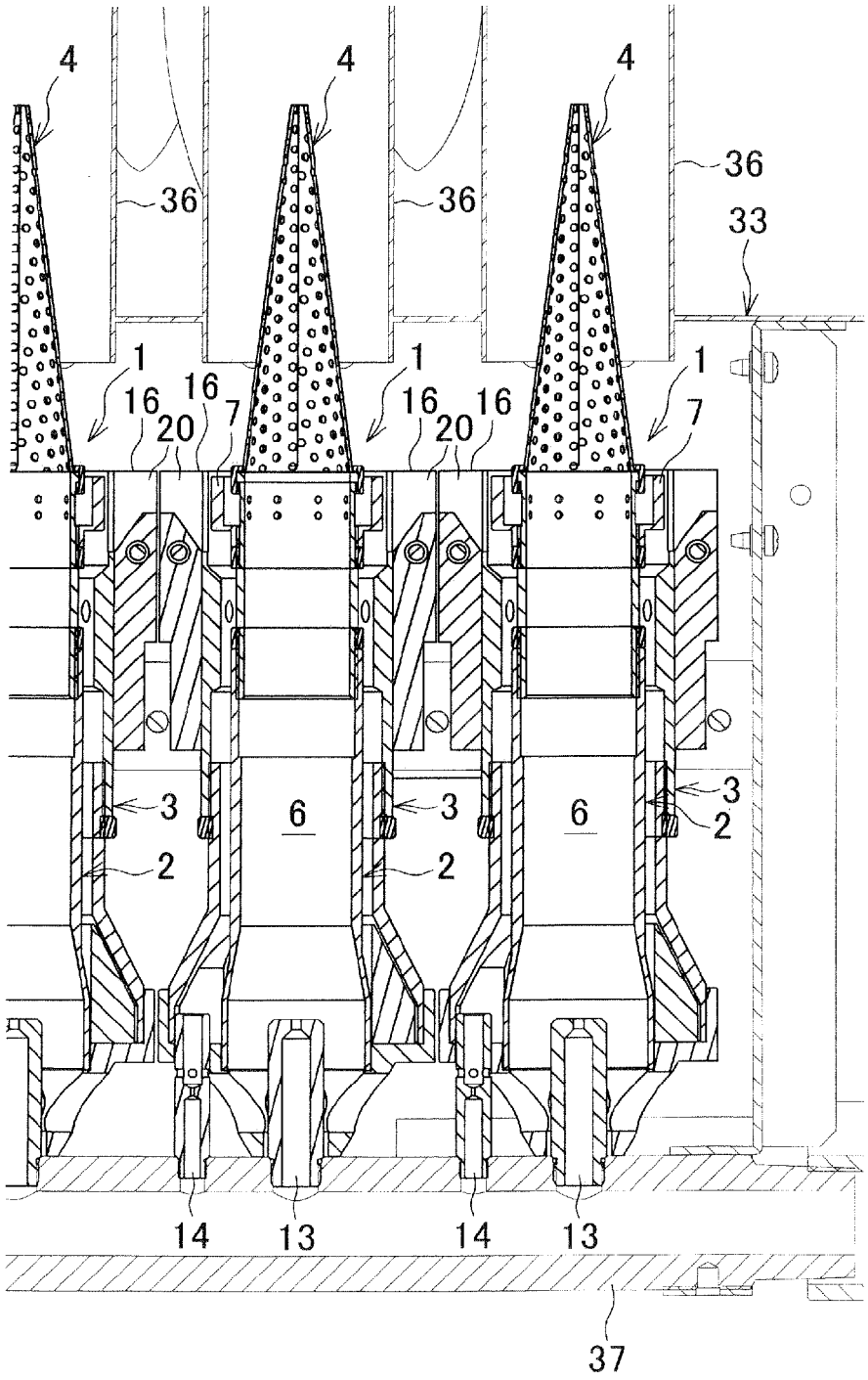
FIG. 7 is an explanatory diagram of a combustion chamber.

The rich-lean burner 1 is used in a warm air heater 30 shown in FIG. 6, for example. Here, a combustion chamber 33 that accommodates a plurality of the burners 1 is provided in a easing 31 having an air inlet 32. The combustion chamber 33 is provided with a secondary air introduction hole 34 that opens in the casing 31, and a secondary air adjustment fan 35. Further, as shown in FIG. 7, the rich-lean burners 1 in the combustion chamber 33 are provided side by side such that they are arranged linearly in a row in a direction in which the flanges 16 of the upper outer cylinder 3*b* are adjacent to each other. The burner heads 4 are respectively inserted into pipe-shaped heat exchangers 36 that are provided continuously on an upper portion of the combustion chamber 33. A reference numeral 37 denotes a gas pipe.

Each of the heat exchangers 36 is bent in a predetermined shape in a heating chamber 38 that is provided above the casing 31. The heat exchangers 36 are joined together above the heating chamber 38 and connected to an exhaust pipe 39. A combustion fan 40 is provided on the upstream side of the exhaust pipe 39, after the heat exchangers 36 are joined. A blower fan 41 is provided on the rear side of the heating chamber 38, and the air sucked in to the heating changer 38 is caused to pass through the heat exchangers 36. Thus, the sucked air can be supplied forward.

In the warm air heater 30, after the combustion fan 40 is rotated, the endmost rich-lean burner 1 is ignited and the rich-lean burner 1 performs combustion. Then, the adjacent rich-lean burner 1 performs combustion catching the rich gas flame F4 of the fire spreading flow path 20. Combustion catching the rich gas flame of the adjacent rich-lean burner is performed in each burner, and all the rich-lean burners 1 that are provided side by side perform combustion. At the same time, the combustion exhaust gas is sucked in by rotation of the combustion fan 40 and is caused to pass through the heat exchangers 36. Thus, heat exchange with the air supplied by the blower fan 41 is performed and warm air is delivered to the front of the heating chamber 38. Further, due to the suction of the combustion exhaust gas, combustion air is introduced from the air inlet 32, and the primary air and the secondary air are supplied.

It should be noted that the secondary air adjustment fan 35 is operated only during a period from the ignition of the rich-lean burner 1 until the combustion becomes stable. This is because of the following reason.

A total amount of the combustion air is large in mass at the time of ignition, and it is small in an equilibrium state during combustion. Therefore, an air-fuel ratio (a ratio of the fuel gas and the primary air) at the time of ignition is also smaller than that in the equilibrium state. Given this, in order to cause the air-fuel ratio at the time of ignition to approach that in the equilibrium state, the secondary air adjustment fan 35 is operated from the ignition until the combustion becomes stable. Thus, an amount of the secondary air is increased while that of the primary air is decreased, and the air-fuel ratio is caused to approach the ratio in the equilibrium state.

Although the general method to increase the secondary air and decrease the primary air at the time of ignition is not limited to the use of the secondary air adjustment fan, it is also conceivable that an opening/closing valve is disposed in a secondary air path. In that case, the opening/closing valve is closed from the ignition until the combustion becomes stable and is thereafter opened. Further, it is also conceivable that an auxiliary fan is disposed in a primary air path, and that the auxiliary fan is stopped from the ignition until the combustion becomes stable and is thereafter operated.

In this manner, according to the rich-lean burner 1 of the above-described embodiment, the burner head 4, which has the plurality of small holes 5 and whose diameter decreases toward the leading end of the burner head 4, is provided on the opening of the inner tube 2. It is therefore possible to increase the surface area of the lean gas flames F1 that are formed on the surface of the burner head 4 and to achieve stable combustion.

Particularly, since the total area of the small holes 5 is made larger than the area of the opening of the inner cylinder 2, the surface area of the lean gas flames F1 is reliably increased, which is favorable for stable combustion.

Further, the intermediate cylinder 7, which is communicatively connected with the inside of the inner cylinder 2 and to which lean gas is supplied, is coaxially provided on the outer periphery of the inner cylinder 2, on the inner side of the outer cylinder 3. Therefore, the flame F2 of the lean gas, whose flow rate is lower than the flow rate of the lean gas blown from the small holes 5, is formed at the base of the burner head 4, and stability of the lean gas flames F1 is increased.

It should be noted that the protruding body is not limited to a conical protruding body that is linearly tapered like the burner head of the above-described embodiment. It may have a rounded tapered shape, or a pyramid shape rather than the conical shape. The shape and arrangement of the small holes are not limited to those of the above-described embodiment, and can be changed as appropriate as long as adjacent flames are not connected. Further, the total area of the small holes can be the same as the area of the opening of the inner cylinder.

Further, in the above-described embodiment, each of the inner cylinder and the outer cylinder is vertically divided into two parts. However, each of the inner cylinder and the outer cylinder may be divided into three or more parts, or conversely, may be formed as a single cylindrical body. In summary, the structural design of the inner cylinder and the outer cylinder can be changed as appropriate.

In addition, if the lean gas flames on the protruding body are stable, the intermediate cylinder can be omitted.

Further, in the above-described embodiment, the core is used to form the guide path that guides the rich gas. However, if a pair of ribs that have an interval corresponding to the slit shape of the core are provided in a standing condition on the outer periphery of the inner cylinder or the inner periphery of the outer cylinder, or if the thickness of the inner cylinder or the outer cylinder is changed, it is also possible to form a guide path which causes the air-fuel mixture blown from the rich gas nozzle to expand toward the upper side and which guides the air-fuel mixture to approach the axis center of the inner cylinder.

In addition, use of the rich-lean burner is not limited to the use in the warm air heater, and the rich-lean burner can also be used in a gas combustion device other than the warm air heater.

What is claimed is:

1. A rich-lean burner comprising:

an inner cylinder to which lean gas is supplied, the lean gas being a mixture of gas and combustion air; and an outer cylinder that is coaxially disposed around the inner cylinder such that rich gas is supplied between the inner cylinder and the outer cylinder, the rich gas being a mixture of gas and combustion air, wherein a protruding body, which has a plurality of small holes and whose diameter decreases toward a leading end of the protruding body, is provided on an opening of the inner cylinder, and an intermediate cylinder, which is communicatively connected with the inside of the inner cylinder and the lean gas is supplied thereto, is coaxially provided on an outer periphery of the inner cylinder, on an inner side of the outer cylinder.

2. A rich-lean burner comprising:

an inner cylinder to which lean gas is supplied, the lean gas being a mixture of gas and combustion air; and an outer cylinder that is coaxially disposed around the inner cylinder such that rich gas is supplied between the inner cylinder and the outer cylinder, the rich gas being a mixture of gas and combustion air, wherein a protruding, body, which has a plurality of small holes and whose diameter decreases toward a leading end of the protruding body, is provided on an opening of the inner cylinder, a total area of the small holes is equal to or more than an area of the opening of the inner cylinder, and an intermediate cylinder, which is communicatively connected with the inside of the inner cylinder and the lean gas is supplied thereto, is coaxially provided on an outer periphery of the inner cylinder, on an inner side of the outer cylinder.

* * * * *